US010023362B2

(12) United States Patent
Hasegawa

(10) Patent No.: US 10,023,362 B2
(45) Date of Patent: Jul. 17, 2018

(54) TUBE COSMETIC CONTAINER

(71) Applicant: AMG Co., Ltd., Tokyo (JP)

(72) Inventor: Hiroki Hasegawa, Tokyo (JP)

(73) Assignee: AMG CO., LTD., Tokyo (JP)

( * ) Notice: Subject to any disclaimer, the term of this patent is extended or adjusted under 35 U.S.C. 154(b) by 134 days.

(21) Appl. No.: 15/124,455

(22) PCT Filed: Mar. 15, 2016

(86) PCT No.: PCT/JP2016/001478

§ 371 (c)(1),
(2) Date: Sep. 8, 2016

(87) PCT Pub. No.: WO2017/158638

PCT Pub. Date: Sep. 21, 2017

(65) Prior Publication Data

US 2018/0086509 A1 Mar. 29, 2018

(51) Int. Cl.

| | |
|---|---|
| ***B67D 3/00*** | (2006.01) |
| ***B65D 35/44*** | (2006.01) |
| ***B65D 35/12*** | (2006.01) |
| ***A45D 40/26*** | (2006.01) |
| ***A45D 34/04*** | (2006.01) |
| ***B65D 35/04*** | (2006.01) |

(52) U.S. Cl.
CPC ..... *B65D 35/44* (2013.01); *A45D 34/04* (2013.01); *A45D 40/26* (2013.01); *B65D 35/04* (2013.01); *B65D 35/12* (2013.01)

(58) Field of Classification Search
CPC ..... A45D 34/00; A45D 34/04; A45D 40/26
USPC ..... 222/549, 546, 548, 92, 106, 107; 401/262, 269, 245–247; 220/318, 254.8; 132/218, 902, 320, 317
See application file for complete search history.

(56) References Cited

U.S. PATENT DOCUMENTS

| | | | | |
|---|---|---|---|---|
| 4,011,879 | A * | 3/1977 | Roberts | A45D 2/00 132/227 |
| 4,776,717 | A * | 10/1988 | Iizuka | A45D 34/042 15/176.1 |
| 4,887,924 | A | 12/1989 | Green | |
| D349,449 | S * | 8/1994 | Linner | D9/442 |
| D351,101 | S * | 10/1994 | Linner | D9/699 |
| 6,293,431 | B1 * | 9/2001 | Seymour | B65D 51/226 222/520 |

(Continued)

FOREIGN PATENT DOCUMENTS

| | | |
|---|---|---|
| JP | 54-73148 | 5/1979 |
| JP | 59-94056 | 6/1984 |

(Continued)

OTHER PUBLICATIONS

International Search Report and Written Opinion received in PCT/JP2016/001478, dated Jun. 21, 2016, 7 pages.

*Primary Examiner* — Lien Ngo
(74) *Attorney, Agent, or Firm* — Procopio Cory Hargreaves and Savitch LLP; Pattric Rawlins

(57) ABSTRACT

The present invention provides a tube cosmetic container that can be used by a user effectively and comfortably in a process of grasping a container main part, a process of turning a cap, and a process of turning the cap again to close an opening of the container main part. A profile of a tube cosmetic container of the present invention is formed in a substantially spindle shape.

1 Claim, 7 Drawing Sheets

(56) References Cited

U.S. PATENT DOCUMENTS

| | | | | |
|---|---|---|---|---|
| 7,175,360 | B2 * | 2/2007 | Zhang | A45D 34/04 401/186 |
| D558,592 | S * | 1/2008 | Soderstrom | D9/699 |
| 7,377,711 | B2 * | 5/2008 | Byun | A45D 34/042 401/269 |
| D717,995 | S * | 11/2014 | Thompson | A45D 34/04 D28/7 |
| 9,126,728 | B1 * | 9/2015 | Elston | B65D 50/041 |
| 9,867,444 | B1 * | 1/2018 | Liu | A45D 34/042 |
| 2010/0059553 | A1 * | 3/2010 | Choi | B65D 35/20 222/496 |
| 2012/0266907 | A1 * | 10/2012 | Chan | A45D 34/042 132/218 |

FOREIGN PATENT DOCUMENTS

| | | | |
|---|---|---|---|
| JP | 1-249006 | A | 10/1989 |
| JP | 7-10130 | A | 1/1995 |
| JP | 2004237111 | A | 8/2004 |
| JP | 2011518598 | A | 6/2011 |
| WO | 02085155 | A1 | 10/2002 |

* cited by examiner

TUBE COSMETIC CONTAINER

FIELD

The present invention relates to a tube cosmetic container.

BACKGROUND

A tube cosmetic container has a tube portion being a container main part that has a cosmetic product such as a serum stored therein, and a cap portion closing an opening of the tube portion as main constituent elements. It is important to such a cosmetic container that the user can operate the cosmetic container effectively and comfortably to take out the cosmetic product such as the serum thereof.

For example, Patent Literature 1 proposes a tube cosmetic container in which, when a cap is turned, a nozzle rises to enable contents to be taken out of the container without detaching the cap.

CITATION LIST

Patent Literature

Patent Literature 1: Japanese Unexamined Patent Application Publication (Translation of PCT Application) NO. 2011-518598

SUMMARY

Technical Problem

When using a tube cosmetic container, the user needs to perform operations of grasping the container main part (step 1), turning the cap (step 2), detaching the cap from the container main part to open the container main part (step 3), taking out the contents (step 4), and turning the cap again to close the opening of the container main part (step 5). The technique described above proposes improvements in steps 3 and 4; however, sufficient improvements are not provided in problems related to steps 1, 2, and 5. That is, while an appropriate force for holding the container main part at steps 1, 2, 3, and 5 is different from that at step 4, the user sometimes performs steps 1, 2, and 3 with a larger force than the appropriate force at step 4 for a conventional container and proceeds to step 4 with the force kept as it is, so that an excess amount of the contents may be ejected, for example.

The present invention has been achieved in view of the above problems and an object of the present invention is to provide a tube cosmetic container that can be used effectively and comfortably by a user in a process of grasping a container main part, a process of turning a cap, and a process of turning the cap again to close an opening of the container main part.

Solution to Problem

A first invention is a tube cosmetic container comprising: a tube container main part; and a cap that closes an opening of the container main part, wherein a profile of the tube cosmetic container is formed in a substantially spindle shape, one of ends of the container main part is a strip-like closed end, the tube cosmetic container has a maximum length d1 in a direction perpendicular to a longitudinal direction of the container at the closed end, a tube neck having an opening is placed at an end on an opposite side to the closed end, one of ends of the cap is a spherical closed end formed in a substantially semispherical shape, an end of the cap on an opposite side to the spherical closed end is an open end to be screwed with the tube neck, assuming a length in the direction perpendicular to the longitudinal direction of the tube cosmetic container at a boundary portion between the container main part and the cap to be a length d2, a ratio $\alpha 1$ (d2/d1) of the length d2 to the length d1 is not less than 0.60 and not more than 0.65, assuming a length of the cap in a direction perpendicular to a longitudinal direction of the tube cosmetic container at a middle position between the boundary portion and the spherical closed end to be a length d3, a ratio $\alpha 2$ (d3/d2) of the length d3 to the length d2 is not less than 0.55 and not more than 0.65 , $\alpha 1 > \alpha 2$, and an outer shape of the closed end of the container main part is formed in a substantially arc shape having a center point on a central axis of the longitudinal direction of the tube cosmetic container and is also formed to set a ratio $\beta 1$ (w1/L1) of a maximum width w1 of the closed end to an entire length L1 of the tube cosmetic container to be not less than 0.02 and not more than 0.04.

The inventors of the present invention studied a tube cosmetic container that generally has a spindle shape and that is operated with a container main part held by one of hands and a cap turned by the other hand on a relation between motions of human palms and fingers and a configuration of the container during the operation of the container. As a result of trials and errors, the inventors found that the configuration of the first invention enabled the user to use the container effectively and comfortably in the process of grasping the container main part, the process of turning the cap, and the process of turning the cap again to close the opening of the container main part.

A second invention is the tube cosmetic container having a configuration of the first invention, wherein a maximum curvature radius at the closed end in the substantially arc shape is not less than 20 millimeters and not more than 30 millimeters.

The inventors of the present invention focused attention on a fact that the fingers of human hands are curved in a natural state, and found after trials and errors that the user could effectively operate the container when the closed end fell within the numerical range descried above.

A third invention is the tube cosmetic container having a configuration of either the first invention or the second invention, wherein a dome member having a closed ceiling and an opening is placed at the open end of the cap, the dome member has a protrusion fitting into the opening of the tube neck at a time of engagement of the container main part with the cap, a substantially upper half of the dome member on a side of the closed ceiling is formed in a double structure including an inner portion and an outer portion, a plurality of partitions are formed between the outer portion and the inner portion, the protrusion is formed on the closed ceiling at a central portion of the inner portion to protrude toward the opening, and a position corresponding to the protrusion on a surface of the closed ceiling on an opposite side to a surface on which the protrusion is placed is a concave portion.

The inventors of the present invention focused attention on a fact that various forces and heats are applied on the tube cosmetic container, and studied a configuration for keeping the protrusion of the cap at a position to be fitted into the opening of the tube neck. The inventors found that the third invention enabled the protrusion to be kept at the position regardless of environmental factors.

Advantageous Effects of Invention

According to the tube cosmetic container of the present invention, the user can use the cosmetic container effectively and comfortably in the process of grasping the container main part, the process of turning the cap, and the process of turning the cap again to close the opening of the container main part.

DESCRIPTION OF EMBODIMENTS

Exemplary embodiments of the present invention will be explained below in detail with reference to the accompanying drawings.

Figure 13:
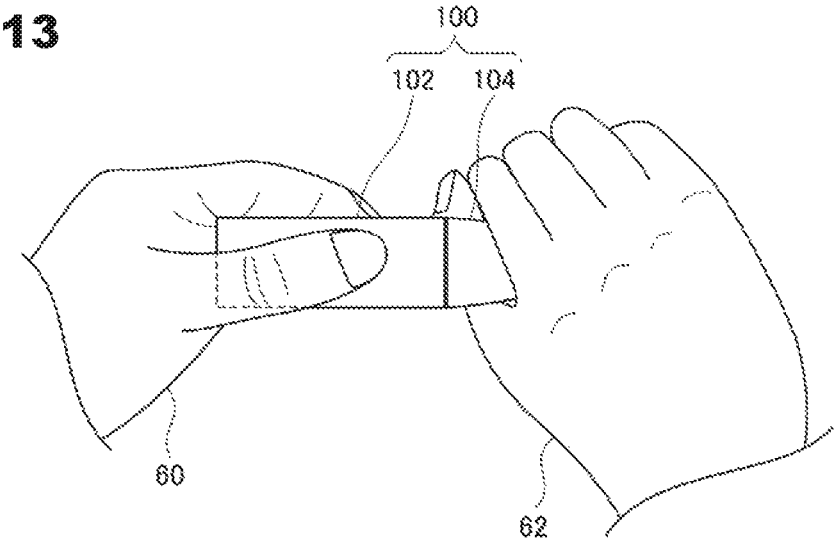
FIG. 13 is a schematic view showing a usage example of a conventional tube cosmetic container.

A conventional tube cosmetic container is explained first with reference to FIG. 13. A cosmetic container 100 includes a container main part 102 that has a cosmetic product such as a serum stored therein, and a cap 104. The container main part 102 and the cap 104 are configured to be screwed by a thread. To detach the cap 104 from the container main part 102, the body of the cap 104 needs to be held between the thumb and the index finger of a right hand 62 of a user and turned thereby while the body of the container main part 102 is held between the thumb and the index finger of a left hand 60, for example. Human hands take natural positions when the both hands are clasped in a natural state in front of the chest. However, the shapes of the both hands in FIG. 13 are unnatural in which the angle of the back of the right hand and the angle of the back of the left hand are substantially orthogonal to each other. In the conventional tube cosmetic container, the shapes of the both hands become unnatural when the cap 104 is to be detached from the container main part 102. Furthermore, due to the need to keep holding the body of the container main part 102 between the thumb and the index finger of the left hand 60 of the user to the last second of detachment of the cap 104, a force applied during the detachment of the cap 104 is sometimes maintained by the thumb and the index finger of the left hand 60 and a force larger than necessary may be applied to the body of the container main part 102 immediately before the cap 104 is detached or also after the cap 104 is detached, which causes an unnecessarily large amount of the cosmetic product to be squeezed out of the container main part 102. The present embodiment can solve the above problems in a manner described below.

As shown in FIGS. 1, 2, 3, and 4, the general shape of a tube cosmetic container 1 (hereinafter, referred to as "container 1") is formed to be substantially spindle-shaped. The container 1 has a tube container main part 10, and a cap 50 that closes an opening of the container main part 10. The cap 50 has a substantially conical shape. The container main part 10 has a body portion 12 that has a cosmetic product stored therein, and one of ends of the body portion 12 is a closed end 14 in a curved strip shape. The closed end 14 is formed by welding one of ends of a cylindrical member in a manufacturing process of the container 1. As described later, the structure of the closed end 14 is one of characteristics of the container 1. The container 1 has a length d1, which is the maximum length in a perpendicular direction to a longitudinal direction (an X axis direction in FIGS. 2 and 3), at the closed end 14. In the present embodiment, the length d1 is 29.8 mm (millimeters). A tube neck 16 is located on the body portion 12 on the opposite side to the closed end 14. A tip of the tube neck 16 is an opening, from which the cosmetic product in the body portion 12 comes out.

Figure 5:
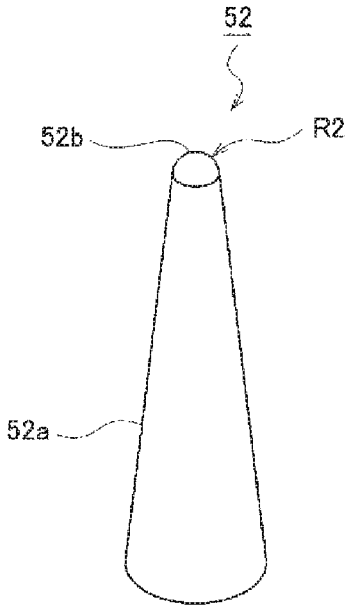
FIG. 5 is a perspective view showing the cap portion.

The cap 50 includes a cap main part 52 and a dome member 54 (see FIGS. 3, 7, and 8) that engages with an inner part of the cap main part 52. The cap main part 52 is formed in such a shape that a hollow conical wall portion 52*a* has one of ends closed by a spherical closed end 52*b* (see FIGS. 3 and 5) formed in a substantially semispherical shape. A curvature radius R2 of a substantial semicircle, which is a cross-section of the spherical closed end 52*b*, is preferably not less than 3 mm and not more than 5 mm, and is 3.2 mm in the present embodiment. An end of the cap main part 52 on the opposite side to the spherical closed end 52*b* has the dome member 54 engaged therewith and is an open end to be screwed with the tube neck 16.

The respective members of the container 1 are formed of resins. The container main part 10 is formed, for example, by welding an end of a hollow member formed by blow molding of polyethylene (PE). The tube neck 16 and the dome member 54 are formed, for example, by injection molding of polypropylene (PP). The cap main part 52 is formed, for example, by injection molding of polyethylene terephthalate (PET).

A length L2 of the container main part 10 accounts for not less than 45% and not more than 55% of an entire length L1 of the container 1. A length L3 of the cap 50 is formed to be equal to or larger than the length L2. In the present embodiment, the length L1 is 130 mm, the length L2 is 64 mm, and the length L3 is 66 mm.

Assuming a length of the container 1 in a perpendicular direction to the longitudinal direction at a boundary portion between the container main part 10 and the cap 50 to be d2, a ratio $\alpha 1$ (d2/d1) of the length d2 to the length d1 is not less than 0.60 and not more than 0.65. Assuming a length of the container 1 in the perpendicular direction to the longitudinal direction at a middle position between the boundary portion between the container main part 10 and the cap 50 and a tip of the spherical closed end 52*b* to be d3, a ratio $\alpha 2$ (d3/d2) of the length d3 to the length d2 is not less than 0.55 and not more than 0.65. Furthermore, the container 1 is formed to meet a relation $\alpha 1 > \alpha 2$. In the present embodiment, d1 is 29.8 mm, d2 is 18.8 mm, and d3 is 11 mm. The ratio $\alpha 1$ (d2/d1) is 0.63 and the ratio $\alpha 2$ (d3/d2) is 0.56.

Figure 1:
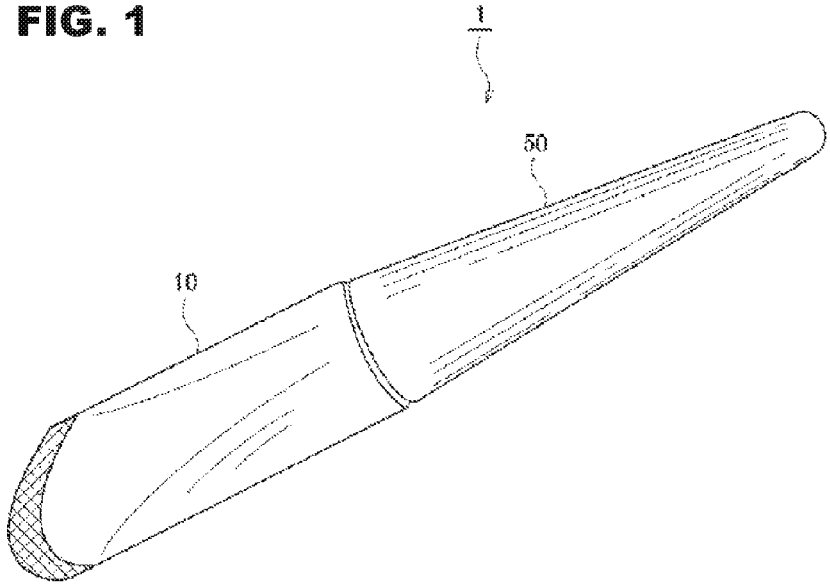
FIG. 1 is a schematic perspective view showing a tube cosmetic container according to an embodiment of the present invention.
Figure 2:
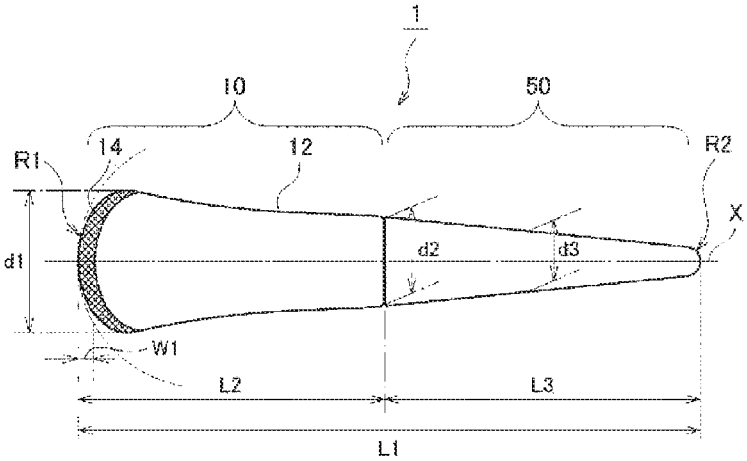
FIG. 2 is a plan view showing the tube cosmetic container.
Figure 3:
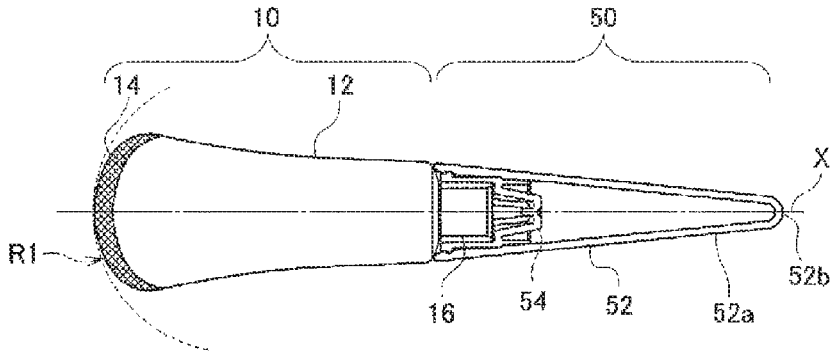
FIG. 3 shows an inner part and the like of a cap portion of the tube cosmetic container.
Figure 4:
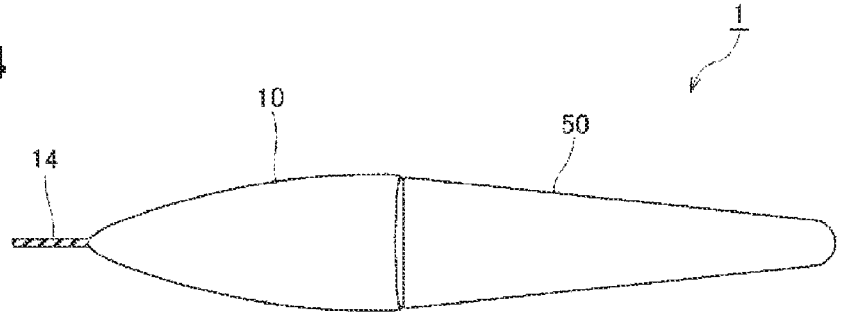
FIG. 4 is a side view showing the tube cosmetic container.

The closed end 14 of the container main part 10 is formed in a substantially arc shape having a center point on a line (the X axis) directed to the spherical closed end 52*b* of the cap 50 and is also formed in such a manner that a ratio $\beta 1$ (w1/L1) of a width w1 being the maximum width of the closed end 14 to the length L1 is not less than 0.025 and not more than 0.050. As shown in FIG. 2, the width w1 is a width at a central axis (the X axis) of the container 1. The width w1 is preferably equal to or larger than 3 mm. In the present embodiment, the width w1 is 4 mm and the ratio β1 (w1/L1) is 0.031. As shown in FIGS. 2 and 3, the closed end 14 is not a perfect arc. An outer curvature radius R1 of the closed end 14 near a portion intersecting with the X axis is preferably not less than 20 mm and not more than 30 mmm, and is 24 mm in the present embodiment. A thickness of the closed end 14 is preferably 1 mm to 2 mm, and is about 1 mm in the present embodiment.

Figure 11:
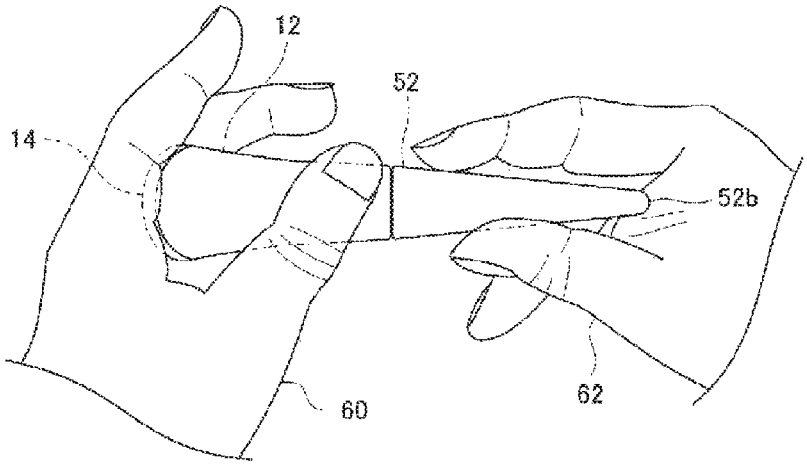
FIG. 11 is a schematic view showing a usage example of the tube cosmetic container.
Figure 12:
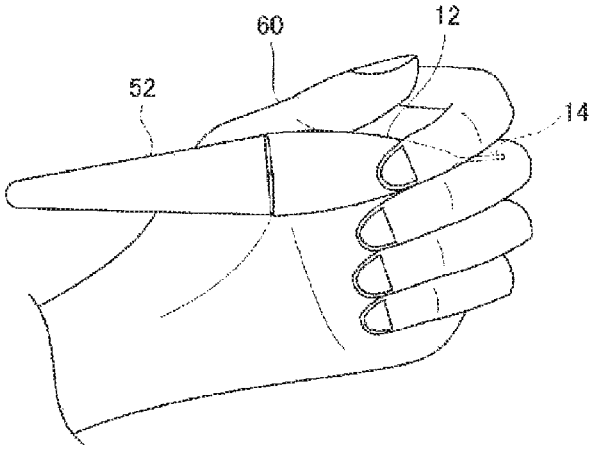
FIG. 12 is a schematic view showing a usage example of the tube cosmetic container.

The inventors of the present invention analyzed favorable shapes of human fingers and the closed end 14, and found after trials and errors that a user could hold the container main part 10 with the closed end 14 sandwiched between two fingers (see FIGS. 11 and 12) to prevent any force from being applied to the body portion of the container main part 10 when the width w1 of the closed end 14 was within the numerical range described above and the curvature radius R1 was within the numerical range described above. That is, the inventors found that the numerical ranges described above were suitable for separating a force to hold the container main part 10 when the cap 50 is detached from the container main part 10 from a force to press the container main part 10 to take the cosmetic product out of the container main part 10. The force to hold the container main part 10 when the cap 50 is turned and detached from the container main part 10 does not cause a large problem even when it is somewhat different from a favorable value. However, the force to eject the contained cosmetic product from the container main part 10 needs to be an appropriate value and fine adjustment of the force is required. The inventors of the present invention found a configuration that enabled to separate the force to grasp the container main part 10 for taking the cosmetic product out of the container main part 10 from the force to take out the cosmetic product, thereby avoiding a risk of ejecting the cosmetic product with an excessive force. In FIGS. 11 and 12, the closed end 14 is sandwiched between the index finger and the middle finger of the left hand 60. The thumb is not in contact with the container main part 10, or only supports the container main part 10 with applying no force even if the thumb is in contact therewith. The inventors of the present invention further found that the closed end 14 could be favorably sandwiched between two fingers, for example, the index finger and the middle finger when the width w1 fell within the numerical range described above. Focusing attention on a fact that the human fingers have natural shapes not in a state stretched straightly but in a state slightly bent, the inventors of the present invention found that the closed end 14 could be sandwiched between two fingers more effectively when the closed end 14 was formed in view of the natural shapes of the fingers. As a result of trials and errors, the inventors found that the curvature radius R1 was preferably within the numerical range described above. While the example in which the closed end 14 is sandwiched between the index finger and the middle finger is shown in FIGS. 11 and 12, the present embodiment is not limited thereto and the closed end 14 can be sandwiched between adjacent two fingers.

The inventors of the present invention also found that, when falling within the numerical range described above, the shape of the cap 50 was suitable for turning the cap 50 with the cap main part 52 being held by the index finger and the thumb of the right hand 62 and the cap main part 52 being lightly supported by the middle finger while the closed end 52*b* of the cap 50 was in contact with a vicinity of the base of the index finger as shown in FIG. 11. That is, in view of a fact that a space formed by the index finger and the middle finger that are slightly spread is substantially conical, a desirable shape of the cap main part 52 at the time of turning the cap 50 was examined through trials and errors. As a result, the inventors found that the shape falling within the numerical range described above was desirable.

It is noteworthy that the angles of the backs of both hands formed when the cap 50 is detached from the container main part 10 in the present embodiment are almost equal and closer to those of the both human hands in the natural shapes as compared to the conventional example shown in FIG. 13. Accordingly, the possibility of application of an excess force is reduced also when the cap 50 is turned and thus the cap 50 can be detached from the container main part 10 while the possibility that an excess force is applied to adversely eject a larger amount of the cosmetic product than necessary is further reduced.

Figure 6:
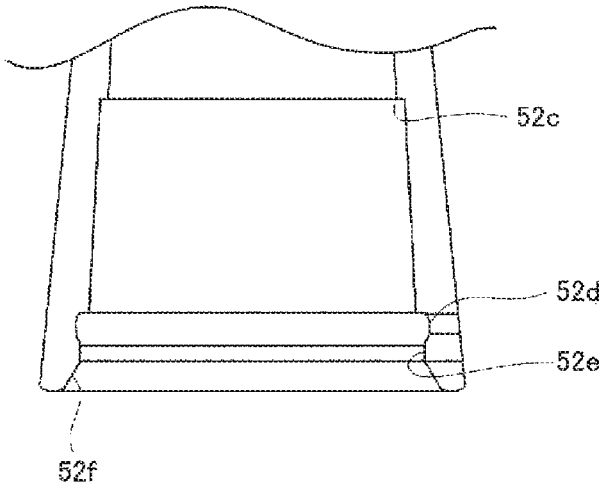
FIG. 6 is a partial enlarged view showing an inner part of the cap portion.

As shown in FIG. 3, the dome member 54 (see FIG. 3) is placed at the open end of the cap 50. A stepped portion 52*c*, a concave portion 52*d*, a convex portion 52*e*, and an inclined portion 52*f* are formed on an inner part of the cap 50 near the open end of the cap 50 on the opposite side to the closed end 52*b* (see FIG. 5) so as to be capable of engaging with the dome member 54 as shown in FIG. 6.

Figure 7:
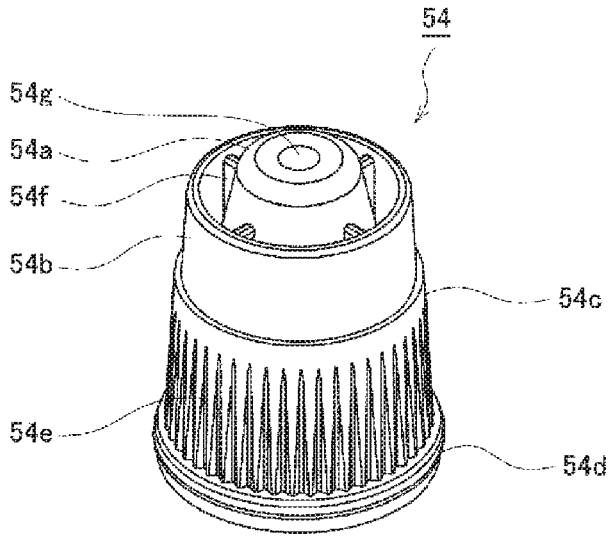
FIG. 7 is a schematic perspective view showing a dome member.
Figure 8:
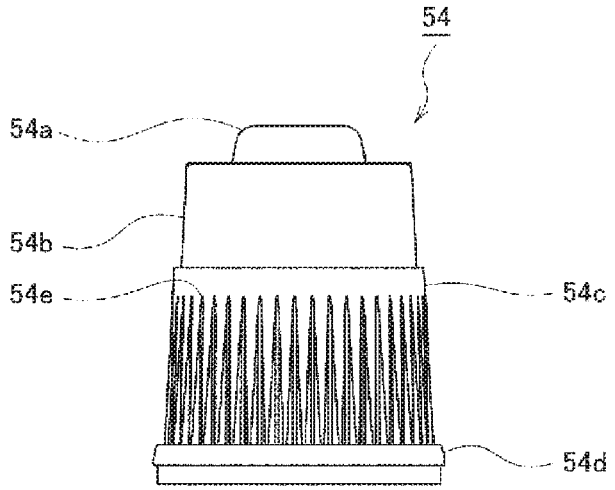
FIG. 8 is a side view showing the dome member.
Figure 9:
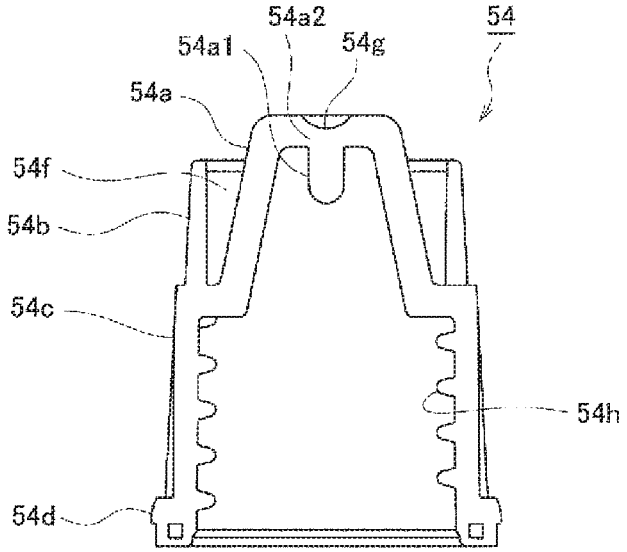
FIG. 9 is a schematic sectional view showing the dome member.
Figure 10:
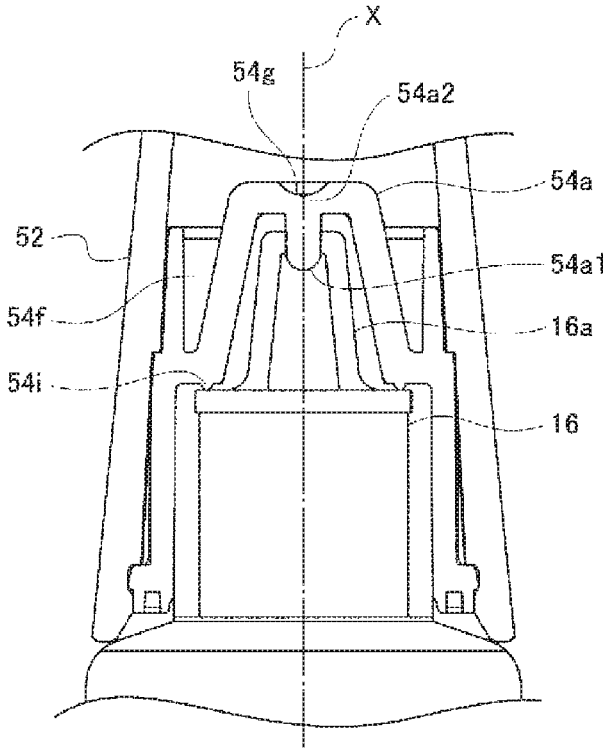
FIG. 10 is a schematic sectional view showing a part of the tube cosmetic container.

As shown in FIGS. 7, 8, and 9, a substantially half of the dome member 54 on the side of a closed ceiling is formed in a double structure including an inner portion 54*a* and an outer portion 54*b*. A plurality of partitions 54*f* are formed between the inner portion 54*a* and the outer portion 54*b*. In the present embodiment, the partitions 54*f* are formed every 90 degrees. That is, four partitions 54*f* are formed. As shown in FIGS. 9 and 10, a protrusion 54*a*1 is formed on the closed ceiling at the position of a central portion of the inner portion 54*a* that is circular in a planar view to protrude toward the opening of the dome member 54. A surface of the dome member 54 on the opposite side to the protrusion 54*a*1 is a concave portion 54*g*. There is a thin portion 54*a*2 between the protrusion 54*a*1 and the concave portion 54*g*. A thread 54*h* is formed on an inner part of a lower portion 54*c* of the dome member 54. A convex portion 54*d* is formed on an outer part of the lower portion 54*c* near a lower end. A plurality of flared portions 54*e* are formed on an external surface of the lower portion 54*c* to surround the lower portion 54*c*.

As shown in FIG. 10, the dome member 54 engages with the cap main part 52. At the time of engagement of the container main part 10 with the cap 50, the dome member 54 engages with the tube neck 16. Threads are formed on the dome member 54 and the tube neck 16, respectively, and are screwed with each other (not shown). A flange portion of the tube neck 16 is configured to come in contact with a circular protrusion 54*i* of the dome member 54.

Due to formation of the dome member 54 in the manner as described above, the protrusion portion 54*a*1 keeps the position and angle to reliably engage with the opening of the tube neck 16 even when there is an environmental factor such as a heat or a force.

The tube cosmetic container of the present invention is not limited to the embodiment described above and various modifications can be made without departing from the scope of the present invention.

REFERENCE SIGNS LIST

1 tube cosmetic container
10 container main part
12 body portion

14 closed end
50 cap
52 cap main part
54 dome member

The invention claimed is:

1. A tube cosmetic container comprising:

a tube container main part;

a cap that closes an opening of the container main part, wherein a profile of the tube cosmetic container is formed in a substantially spindle shape, one of ends of the container main part is a strip-like closed end, the tube cosmetic container has a maximum length d1 in a direction perpendicular to a longitudinal direction of the container at the closed end, a tube neck having an opening is placed at an end on an opposite side to the closed end, one of ends of the cap is a spherical closed end formed in a substantially semispherical shape, an end of the cap on an opposite side to the spherical closed end is an open end to be screwed with the tube neck, assuming a length in the direction perpendicular to the longitudinal direction of the tube cosmetic container at a boundary portion between the container main part and the cap to be a length d2, a ratio $\alpha 1$ (d2/d1) of the length d2 to the length d1 is not less than 0.60 and not more than 0.65, assuming a length of the cap in a direction perpendicular to a longitudinal direction of the tube cosmetic container at a middle position between the boundary portion and the spherical closed end to be a length d3, a ratio $\alpha 2$ (d3/d2) of the length d3 to the length d2 is not less than 0.55 and not more than 0.65, $\alpha 1 > \alpha 2$, and an outer shape of the closed end of the container main part is formed in a substantially arc shape having a center point on a central axis of the longitudinal direction of the tube cosmetic container and is also formed to set a ratio $\beta 1$ (w1/L1) of a maximum width w1 of the closed end to an entire length L1 of the tube cosmetic container to be not less than 0.02 and not more than 0.04, wherein a maximum curvature radius at the closed end in the substantially arc shape is not less than 20 millimeters and not more than 30 millimeters; and a dome member having a closed ceiling and an opening is placed at the open end of the cap, the dome member has a protrusion fitting into the opening of the tube neck at a time of engagement of the container main part with the cap, a substantially upper half of the dome member on a side of the closed ceiling is formed in a double structure including an inner portion and an outer portion, a plurality of partitions are formed between the outer portion and the inner portion, the protrusion is formed on the closed ceiling at a central portion of the inner portion to protrude toward the opening, and a position corresponding to the protrusion on a surface of the closed ceiling on an opposite side to a surface on which the protrusion is placed is a concave portion.

* * * * *